United States Patent [19]

Klaucic

[11] Patent Number: 4,623,016

[45] Date of Patent: Nov. 18, 1986

[54] DEVICE FOR PARKING THE DUMMY BAR UPSTREAM FROM THE EXTRACTION AND STRAIGHTENING GROUP

[75] Inventor: Luciano Klaucic, Ronchi Dei Legionari, Italy

[73] Assignee: Danieli & C. Officine Meccaniche S.p.A., Buttrio, Italy

[21] Appl. No.: 614,636

[22] Filed: May 29, 1984

Related U.S. Application Data

[63] Continuation-in-part of Ser. No. 379,309, May 18, 1982, abandoned.

[30] Foreign Application Priority Data

May 20, 1981 [IT] Italy ..... 83387 A/81

[51] Int. Cl.[4] ..... B22D 11/08

[52] U.S. Cl. ..... 164/425; 164/445

[58] Field of Search ..... 164/425, 426, 445, 446

[56] References Cited

U.S. PATENT DOCUMENTS

| | | | |
|---|---|---|---|
| 3,351,124 | 11/1967 | Hess | 164/426 |
| 3,446,270 | 5/1969 | Michelson | 164/426 |
| 3,542,118 | 11/1970 | Rossi et al. | 164/426 |
| 3,593,792 | 7/1971 | Hess | 164/446 |
| 3,692,094 | 9/1972 | Wagner | 164/426 |
| 4,043,383 | 8/1977 | Isenberg et al. | 164/426 |

FOREIGN PATENT DOCUMENTS

| | | | |
|---|---|---|---|
| 0066550 | 12/1982 | European Pat. Off. | 164/426 |
| 26426 | 8/1970 | Japan | 164/446 |
| 55-100859 | 8/1980 | Japan | 164/445 |
| 1195152 | 6/1970 | United Kingdom | 164/426 |

*Primary Examiner*—Nicholas P. Godici
*Assistant Examiner*—G. M. Reid
*Attorney, Agent, or Firm*—Stevens, Davis, Miller & Mosher

[57] ABSTRACT

Parking device for dummy bars which can be employed in continuous casting machines with a roller-type casting line stretching between the ingot mold and a substantially horizontal outlet, and an extraction and straightening group located at the outlet, in which the device comprises; a swinging parking structure to park the dummy bar, the structure being pivoted at one end upstream from the extraction and straightening group and being able to rotate around a pivot between a raised position of rest and a lowered working position, a jack able to move the free end of the parking structure between the position of rest and the working position and a further jack anchored to the parking structure and acting to pull the dummy bar to the ingot mold.

6 Claims, 2 Drawing Figures

DEVICE FOR PARKING THE DUMMY BAR UPSTREAM FROM THE EXTRACTION AND STRAIGHTENING GROUP

This application is a continuation-in-part of U.S. patent application Ser. No. 379,309 filed May 18, 1982.

This invention relates to a parking system for the dummy bar normally used for withdrawing continuous billets in continuous casting plants.

More particularly, this invention relates to a parking structure from the dummy bar whereby the structure is located upstream from the extraction and straightening support and swings between two positions, the first position parking the dummy bar during its phase of rest, whereas the second position supporting and guiding the dummy bar during its initial insertion and during the starting phase of the continuous billet.

In the art of continuous casting the molten metal is carried in a wheeled ladle or conveyed by a crane to an ingot mold having an open bottom of a suitable shape located above the casting line.

The ingot mold receives the molten metal from the ladle through a pre-heated tundish and discharges the metal from below through its open bottom in a partly solidified continuous flow having a pre-set section. This flow solidifies little by little on the casting line with the help of suitable cooling means positioned in the first part of the casting line.

Before casting has begun, it is necessary to close the open bottom of the ingot mold temporarily so as to stop the metal running out in a disorderly way.

Closure of the open bottom of the ingot mold is carried out by means of a dummy bar, which is inserted into the open bottom of the ingot mold by a group of entraining rollers, any gap created between the dummy bar and the open bottom of the ingot mold being sealed with some suitable refractory material.

The first part of the metal poured into the ingot mold is left to solidify partly so that it can become united to the detachable head of the dummy bar.

After the ingot mold has been filled and shaken to hinder the formation of a crust of metal on its inner walls, the entraining rollers are set in motion and arranged to pull the dummy bar and the end of the billet connected to the end thereof.

The dummy bar is detached thereafter from the billet and parked in a suitable position downstream from the extraction group and from the discharge line, along which the cast metal goes on travelling for the rolling operations thereafter.

The dummy bar, now equipped with a new head, is withdrawn once again from its parked position at the beginning of the next casting and follows the aforesaid procedure for starting the next billet.

The known dummy bars are substantially of three kinds: rigid bow-shaped dummy bars, semi-rigid bow-shaped dummy bars consisting of a number of articulated segments and flexible chain-type dummy bars.

The known systems for parking rigid dummy bars or semi-rigid dummy bars consisting of segments require a stationary supporting structure shaped like a bow, lying on the vertical plane of the casting line and stretching down to the extraction group, and terminate at a point in height not lower than the height of the ingot mold.

U.S. Pat. Nos. 3,930,533 (Rokop), 3,433,287 (Greeberger) and 3,344,844 (Reinfeld and others), which describe parking systems for dummy bars of such a type, show certain problems regarding the bulky construction, heavy weight and unsatisfactory lay-out of the stationary bow-shaped structures.

U.S. Pat. No. 3,682,233 (Rokop and others) claims a parking system for flexible dummy bars which consists of a substantially upright stationary structure with a horizontal tract and is located above the extraction group and casting line, whereby a secondary entraining group is lodged in the horizontal tract so as to move the dummy bar into the bearing structure.

In all the aforesaid known systems the parking means are located downstream from the extraction and straightening group.

Notwithstanding the advantages provided by this system in terms of smaller bulk than with the known systems, it still takes up a great deal of space and is only fit for flexible dummy bars.

In fact, the structure proposed by this patent stretches vertically above the ingot mold and takes up much useful space near the extraction group and also near the upper part of the casting plant.

It should be emphasized, moreover, that all the foregoing known parking systems are positioned downstream from the extraction and straightening group and this fact makes it necessary for the dummy bar to have a length of arc not less than the length of the casting line or than the path of the billet between the ingot mold and the entraining rollers of the extraction and straightening group.

Another problem common to the aforesaid known parking systems lies in the fact that the new head of the dummy bar can only be fitted near the extraction group.

The purpose of the invention is to provide the best parking lay-out for the dummy bar in a continuous casting plant, whereby the lay-out reduces the sizes and simplifies the construction and working of the parking system and thereby leads to a considerable reduction of the length of the dummy bar.

This purpose is attained with a parking device for dummy bars of smaller sizes which is located upstream from the extraction and straightening group and swings between a raised position of rest and a lower working position corresponding to the casting line and which takes up less space than known parking devices and has a lighter and cheaper construction.

One advantage lies in the fact that, as the swinging parking device of the invention is located between the ingot mold and the extraction and straightening group, the length of the dummy bar and therefore the length of the parking device itself are considerably reduced since the length of dummy bar required is now substantially less than half of the length of the curved casting path between the ingot mold and the extraction and straightening group.

Another advantage is the ability to fit the new head to the dummy bar during its phase of rest in the raised position.

This leads to a great saving of time and thereby to higher output owing to the noteworthy lessening of downtimes inherent in the readying of the machine.

A further advantage is the free space brought about in the casting phase downstream from the extraction group and near the discharge line, for the space can be used for other more useful purposes.

The invention is therefore embodied in a parking device for dummy bars, particularly rigid dummy bars, which can be employed in continuous casting machines with roller-wise casting lines stretching between the ingot mold and the substantially horizontal outlet of the machine, the machines comprising an extraction and straightening group located at the outlet, whereby the device comprises a swinging parking structure to support rigid dummy bars which is pivoted at its lower end upstream from the extraction and straightening group and is able to revolve around a pivot between a raised position of rest and a lowered working position, lifting means which can raise the free end of the parking structure from its working position to the position of rest, and thrust means anchored to the parking structure and acting also to maintain the dummy bar on the parking structure, whereby entraining means are positioned on the casting line upstream from the parking structure and can pull the dummy bar along the casting line along both means for detaching the head of the dummy bar from the billet.

In a preferential embodiment of the invention the parking structure has a shape like a cradle with a substantially bow-shaped profile and a U-shaped section and swings around a rotation shaft located in the opposite part to the ingot mold, whereby the lifting means are revolvably anchored at one end to the stationary structure of the machine and pivoted at their other end on the cradle structure, which in turn bears the thrust means for the rigid dummy bar which are able to carry out any displacements of the dummy bar and the maintaining of the same during the phase of rest.

The detachment of the head of the rigid dummy bar takes place advantageously upstream from the cradle-like parking structure.

Other details and features of the invention will stand out from the description given below by way of non-lmitative example and with reference to the accompanying drawings, in which.

In the figures the same parts or parts having the same functions bear the same reference numbers.

Figure 1:
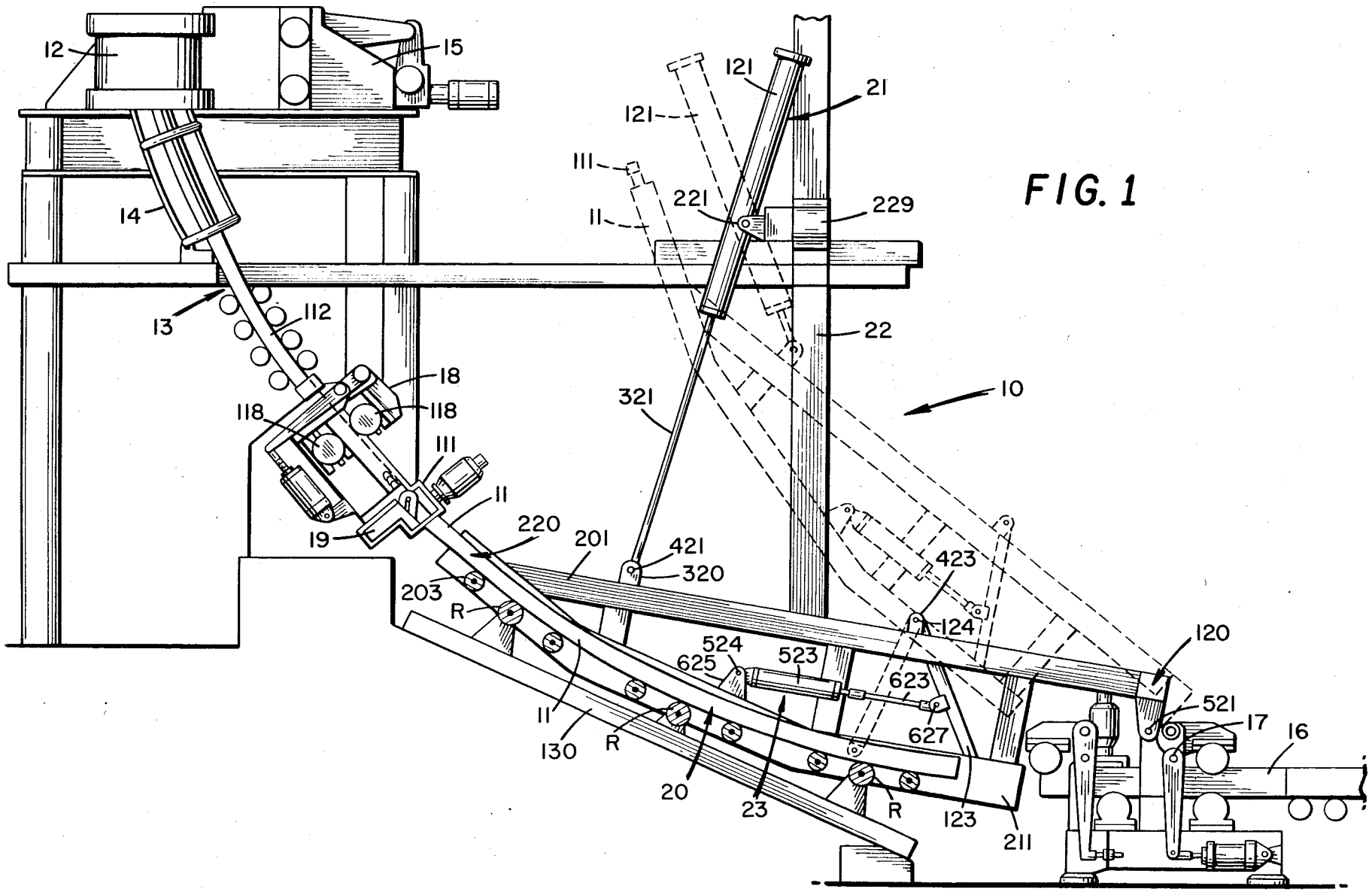
FIG. 1 shows a side view of the continuous casting machine together with the cradle structure for parking the rigid dummy bar according to the invention.
Figure 2:
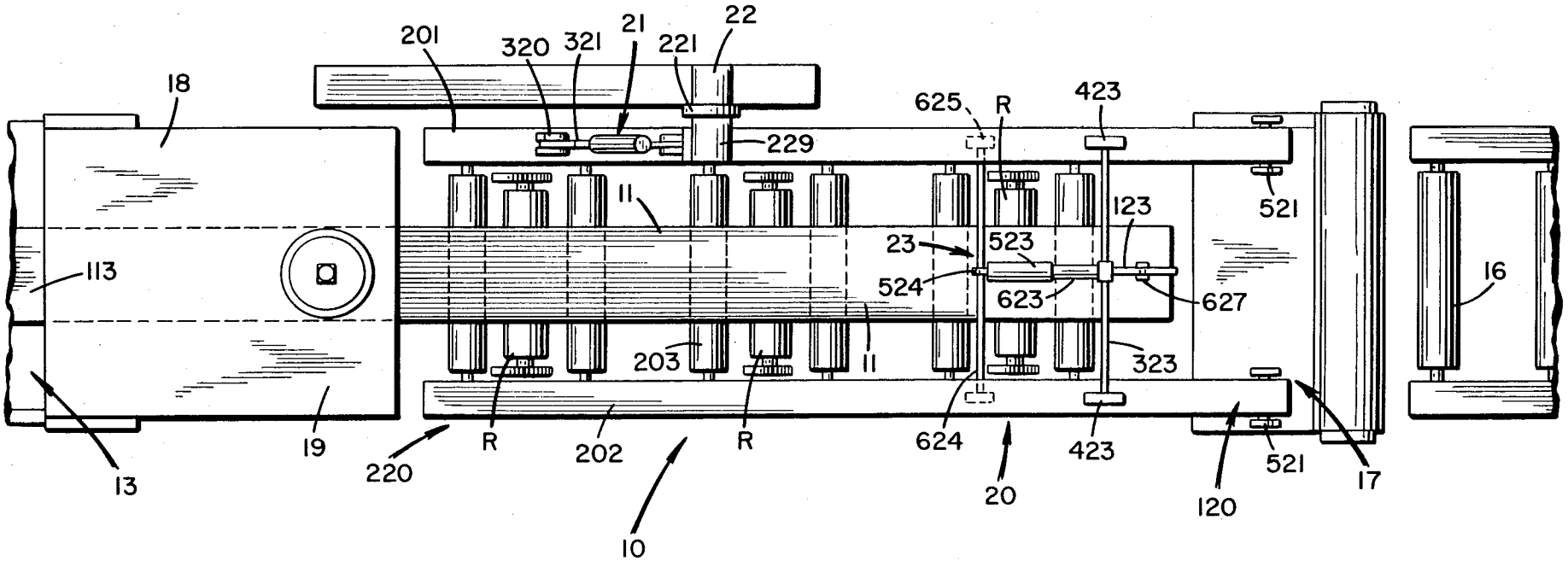
FIG. 2 shows the embodiment of FIG. 1 from above in its working position the dashed lines of FIG. 1.

FIG. 1 shows a continuous casting machine to which is fitted the parking device 10 for the rigid dummy bar 11 with a removable head 111.

In general, the casting machine consists of an ingot mold 12 with an open bottom installed above the casting line 13 and fed from above by a ladle through a heated tundish (not shown here).

A cooling chamber is usually located in the upper part of the casting line 13 and serves to speed up the solidification of the cast metal.

The ingot mold is also oscillated by a suitable oscillation group 15 of a known kind.

The casting line 13 is followed by the generally horizontal discharge line 16, at the inlet of which the extraction and straightening group 17 is located.

According to the invention the device 10 to park the rigid dummy bar 11 is fitted so as to correspond with the end tract of the curved casting line 13 and upstream from the extraction and straightening group 17, the casting line 13 being equipped in the end tract with a supporting structure 130 able to lodge rollers R above the bottom of the parking device in its working position.

The three rollers R shown in FIG. 1 form part of the casting line and enter through spaces in the bottom of parking devices 12 to help support the rigid dummy bar when the parking device 10 is in its working position.

Moreover, according to the invention entraining means of a known type with drawing rollers 118 are located after the casting line 13 and near the intake of a swinging parking device 10 and are followed by means 19 which are themselves known and able to detach the head 111 of the rigid dummy bar 11.

During the phase of preparing for the casting the entraining means 18 serve to insert the dummy bar 11 into the bottom of the ingot mold 12 and also to withdraw the dummy bar 11 together with the billet 112 at the beginning of casting and also take part, together with the group 17, in extracting the billet 112 after the latter has been detached from the rigid dummy bar 11.

According to a preferential embodiment of the invention the parking device 10 consists of a cradle-like parking structure 20 having a U-shaped section with two upright sides 201 and 202, a bow-shaped bottom with rollers 203 and the same curvature as the casting line 13. The lower end 120 of the cradle structure is pivoted at 521 on the extraction and straightening group 17, whereas its upper end 220 is free to be revolved between a lower working position corresponding with the casting line 13 and a raised position of rest by means of lifting means 21 anchored to the carrying structure 22 of the machine.

According to the invention thrust means 23 are fitted to the cradle structure near its pivoted end 120 to push the dummy bar 11 towards the free end 220 of the cradle-like parking structure 20 and prevent it from slipping towards the lower end 120 of the cradle structure 20.

The thrust means 23 also carry out delivery of the head 111 of the rigid dummy bar 11 to the entraining means 18 during the phase of insertion of the rigid dummy bar 11.

In the preferential embodiment of the invention the lifting means 21 consist of a jack 121 pivoting on the carrying structure 22 of the machine at 221 by means of the support 229 and having the end of its stem 321 pivoting at 421 on a support 320 anchored to the upper surface of one 201 of the upright sides 201,202 of the swinging cradle structure 20.

The thrust means 23 consist of an arm 123 swinging along the lengthwise axis of the cradle structure 20 and having its upper end pivoting at 124 around a crosswise shaft 323 anchored at its ends to appropriate supports 423, of which each is anchored to the upper surface of the relative upright side 201,202 of the cradle structure 20. The arm 123 is actuated by a jack 523 located centrally along the axis of symmetry of the swinging cradle structure 20 and having one of its ends pivoted at 524 on a crosswise shaft 624 anchored terminally to appropriate supports 625, which are themselves anchored to the surface of the upright sides of the swinging cradle structure 20 upstream from and below the rotation shaft 323 of the swinging arm 123, the stem 623 of the jack 523 being pivoted at its end at 627 on the swinging arm 123.

The free end of the arm 123 is slightly bent towards the upper end 220 of the swinging cradle structure 20 so as to cooperate with the tail 211 of the rigid dummy bar 11 and to prevent it from slipping towards the lower end 120 of the swinging cradle structure 20.

It is evident that the actuating jacks 121,523 can be hydraulic or pneumatic but also be replaced with other suitable motive means with the necessary transmission organs.

It is also evident that the operation and working of the various means are coordinated by means which are known and therefore not described here.

The invention works as follows. To begin the casting, the swinging cradle structure 20 bearing the dummy bar 11 with the removable head 111 is positioned in its working position along the casting line 13, such that the rollers R on the supporting structure 130 and the rollers 203 of the cradle structure 20 together form a section of the casting line.

The thrust means 23 are then actuated and push the rigid dummy bar 11 until its head lies beyond the pulling rollers 118 of the known insertion and withdrawal group 18, which now arranges to insert the rigid dummy bar 11 into the bottom of the ingot mold 12.

The ingot mold is now readied to receive the molten metal from the ladle through the tundish.

Following the prtail solidification of the molten metal in the ingot mold 12 and the union of the metal with the detachable head 111 of the rigid dummy bar 11, the group 18 is actuated again in the reverse direction so as to withdraw the rigid dummy bar 11 and the actual billet therewith.

The rigid dummy bar 11 descends during this phase into the swinging cradle structure 20, which is still located in its working position in correspondence with the casting line 13.

When the head 111 of the dummy bar 11 is detached thereafter from the bar 11 by the detaching means 19, the lifting means 21 are actuated at once and arrange to rotate the cradle structure 20 clockwise together with the rigid dummy bar 11 but without the head 111 thereof, which stays united with the billet 112 moving towards the extraction and straightening group 17 and the roller discharge table 16.

The thrust means 23 ensure the maintaining of the rigid dummy bar 11 on the cradle structure 20 during the transfer thereof from its working position and also in the raised position of rest thereof.

In the position of rest the machine operators make ready the new head 111, which is fitted to the rigid dummy bar 11, and prepare the rigid dummy bar for the next casting.

So as to begin the next casting, the cradle structure 20 is lowered and located in its working position on the casting line by the lifting means 21. The foregoing process of inserting the rigid dummy bar 11 with its new head 11 is carried out thereafter.

Although the invention has been described utilizing a rigid dummy bar, semi-rigid bow-shaped and chain-type dummy bars may be used.

A preferential embodiment of the invention has been described, but further variants are possible for a person skilled in this field without departing from the scope of the invention.

I claim:

1. Parking device for rigid curved dummy bars employed in continuous casting machines with a curved roller-type casting line stretching between the ingot mold and a substantially horizontal path at the inlet of which an extraction and straightening group is located, comprising a swinging parking structure having the same curvature as the casting line for parking a dummy bar having a free end and a fixed end pivotally attached proximal to said extraction and straightening group and rotatable around said pivotal attachment between a raised position of rest and a lowered working position, lifting means to move the free end of said parking structure between said position of rest and the working position, and thrust means anchored to said parking structure to force the dummy bar upwardly into the ingot mold when engaging the casting, said structure while in its working position defining rollers which form part of the casting line.

2. The parking device as in claim 1, wherein said swinging parking structure has a shape like a cradle with a substantially bow-shaped profile and a U-shaped cross-section, said pivotal end pivoting on the extraction and straightening group.

3. The device as in claim 2, wherein said cradle structure has two upright sides and rollers connecting the sides at their lower end in the form of a bow-shaped bottom, said bottom having the same curvature as the casting line.

4. The device as in claim 2, wherein said cradle structure has a length of arc substantially less than half of the length of the casting line stretching between the ingot mold and the extraction and straightening groups.

5. The device as in claim 1, including a carrying structure and wherein, said lifting means consist of a substantially vertical jack pivotable at its upper end on a support solidly fixed to said carrying structure and having the end of its stem pivotable on an upright side of the cradle structure by means of support solidly fixed to said cradle structure near the free end thereof.

6. The device as in claim 1, including a swinging arm having a pivotable end and a free end and wherein said thrust means comprise a substantially central jack carrying a stem and pivoting at one end around a crosswise shaft anchored at its ends by supports to the cradle structure, said stem of the jack being pivotable at an intermediate point on said swinging arm pivoting at an upper end on a crosswise shaft anchored at its ends to two upright supports solidly fixed to the top of said cradle structure, said free end of said swinging arm following an arc tangent to the lengthwise axis of said cradle structure.

* * * * *